US010428475B2

(12) United States Patent
Weseman et al.

(10) Patent No.: US 10,428,475 B2
(45) Date of Patent: Oct. 1, 2019

(54) COLLAPSIBLE LANE DELINEATOR

(71) Applicant: Saris Cycling Group, Inc., Madison, WI (US)

(72) Inventors: Kurt R. Weseman, West Haven, CT (US); John R. Laverack, Southbury, CT (US); Gregory A. Thomas, Stratford, CT (US); Daniel E. Stromborg, Los Angeles, CA (US)

(73) Assignee: Saris Cycling Group, Inc., Madison, WI (US)

( * ) Notice: Subject to any disclaimer, the term of this patent is extended or adjusted under 35 U.S.C. 154(b) by 0 days.

(21) Appl. No.: 16/004,827

(22) Filed: Jun. 11, 2018

(65) Prior Publication Data

US 2018/0355566 A1 Dec. 13, 2018

Related U.S. Application Data

(60) Provisional application No. 62/518,299, filed on Jun. 12, 2017.

(51) Int. Cl.

| | |
|---|---|
| ***E01F 13/04*** | (2006.01) |
| ***E01F 9/60*** | (2016.01) |
| ***E01F 15/00*** | (2006.01) |
| ***E01F 9/588*** | (2016.01) |
| *E01F 13/02* | (2006.01) |

(52) U.S. Cl.

CPC ..... *E01F 13/044* (2013.01); *E01F 9/588* (2016.02); *E01F 13/048* (2013.01); *E01F 15/00* (2013.01); *E01F 13/024* (2013.01)

(58) Field of Classification Search

CPC ..... B65G 69/2888; B62D 53/062; E06B 2009/002; E01F 13/024; E01F 13/044; E01F 9/588; E01F 15/148; E01F 15/146; E01F 13/12; E01F 15/088; E01F 15/00; E01F 15/086; E01F 15/003; E01F 9/629; E01F 9/619; E01F 9/627; E01F 15/006; E01F 15/02; E01F 15/10; E01F 15/12; E01F 9/553; E01F 9/565; E01F 9/573;

(Continued)

(56) References Cited

U.S. PATENT DOCUMENTS 2,185,020 A 12/1939 Vostrez
2,881,662 A * 4/1959 Harris ..... B60Q 7/005 116/63 P (Continued)

*Primary Examiner* — Abigail A Risic
(74) *Attorney, Agent, or Firm* — Boyle Fredrickson, S.C.

(57) ABSTRACT

A collapsible boundary delineator includes a base for placement on a ground surface and a divider member that is movable relative to the base between a raised, operative position and a lowered, inoperative position. The base includes a pair of base members that are engageable with each other, and the divider member includes a pair of spaced apart ends secured one to each of the base members. When the base members are engaged together the divider member is in the raised, operative position and when the base members are disengaged from each other the divider member is in the lowered, inoperative position. A selectively releasable latch arrangement carried by the base members is movable between a latching position for selectively maintaining the base members in engagement with each other and a release position for selectively enabling the base members to be moved apart from each other.

17 Claims, 12 Drawing Sheets

(58) Field of Classification Search
CPC ..... E01F 9/578; E01F 9/594; E01F 9/602; E02D 29/0208
See application file for complete search history.

(56) References Cited

U.S. PATENT DOCUMENTS 4,197,807 A 4/1980 Campbell
4,462,145 A * 7/1984 Schulze ..... E01F 9/688 116/63 T
4,541,190 A * 9/1985 Weiner ..... G09F 7/00 40/124.15
4,597,691 A 7/1986 Clarke
4,690,583 A * 9/1987 Faulconer ..... E01D 19/103 404/12
4,822,206 A * 4/1989 Roussel ..... E01F 13/085 404/10
4,928,415 A * 5/1990 Walters ..... G09F 1/06 40/610
4,977,697 A * 12/1990 Genick ..... G09F 15/0062 40/539
5,009,542 A * 4/1991 Hardin, Jr. ..... E01F 15/12 404/6
5,059,060 A 10/1991 Steinhardt
5,090,349 A * 2/1992 Wilson ..... E01F 9/654 116/63 C
5,168,827 A * 12/1992 Junker ..... E01F 9/688 116/63 C
5,498,100 A 3/1996 Guernsey
5,639,178 A * 6/1997 Wilson ..... E01F 13/085 404/6
5,775,833 A * 7/1998 Little ..... E01F 9/646 116/63 P
6,065,900 A 5/2000 Reale
6,435,762 B1 * 8/2002 Markling ..... E01F 9/688 404/6
6,508,195 B1 * 1/2003 Tipaldo ..... B60Q 7/00 116/63 P
6,615,523 B1 * 9/2003 Curbelo ..... G09F 7/00 116/63 P
6,681,715 B2 * 1/2004 Wood ..... E01F 9/688 116/63 P
6,995,495 B2 2/2006 Ko et al.
7,011,470 B1 3/2006 Breazeale et al.
7,168,886 B2 1/2007 Loader
7,377,718 B2 5/2008 Russo
7,703,228 B2 * 4/2010 Zheng ..... E04H 15/40 116/63 T
7,862,252 B2 1/2011 Gelfand et al.
8,845,877 B2 9/2014 Cole et al.
2005/0220536 A1 10/2005 Blair et al.
2007/0266925 A1 * 11/2007 Tipaldo ..... E01F 9/688 116/63 C
2011/0308446 A1 * 12/2011 Butler ..... E01F 13/02 116/63 C
2014/0377001 A1 12/2014 Gassman
2018/0135262 A1 * 5/2018 Stevens ..... E01F 13/02

* cited by examiner

COLLAPSIBLE LANE DELINEATOR

CROSS-REFERENCE TO RELATED APPLICATION

This application claims the benefit of U.S. provisional patent application Ser. No. 62/518,299 filed Jun. 12, 2017, the entire disclosure of which is hereby incorporated by reference.

BACKGROUND AND SUMMARY

In certain environments, it is desirable to provide a demarcation between an area intended for one use from an area intended for another. For instance, in the case of a road, street or path, it is known to provide pavement markings to provide a visual indication of an area intended for one use as opposed to an area intended for another use. A representative example involves demarcation of a lane intended for use by bicyclists from lanes or areas intended for foot traffic or vehicle traffic. While pavement markings are useful, it is sometimes advantageous to provide an actual physical barrier. In some cases, a barrier may be provided by a curb or low wall, which provides a relatively permanent and stationary barrier. In other cases, it may be desirable to provide a barrier that is less permanent and that still provides a vertical element that extends upwardly from pavement level to provide both a visual and a physical barrier, even though the physical nature of the barrier may be less robust and permanent than, for example, a curb or wall. The present invention is intended to provide such a barrier.

According to an embodiment of the present invention, a collapsible boundary delineator includes a base adapted to be positioned on a ground surface, and a divider member interconnected with the base. The divider member is movable relative to the base between a raised, operative position and a lowered, inoperative position. In one form, the base comprises a pair of base members that are selectively engageable with each other and the divider member includes a pair of spaced apart ends. Each of the divider member ends is secured to one of the base members. When the base members are engaged together the divider member is in the raised, operative position and when the base members are disengaged from each other and moved apart, the divider member is in the lowered, inoperative position.

The pair of base members may include releasable engagement structure that can be engaged together to maintain the base members in engagement with each other and that can be disengaged to enable the base members to be moved apart from each other. The releasable engagement structure may be in the form of an engagement opening located at an end of one of the base members and an engagement tab located at a facing end of the other of the base members. The engagement tab is selectively positioned within the engagement opening to maintain the base members in engagement with each other. A selectively releasable latch arrangement carried by the base members is movable between a latching position for selectively maintaining the base members in engagement with each other, and a release position for selectively enabling the base members to be moved apart from each other. A retainer arrangement may be interposed between the base members and the divider member for selectively maintaining the divider member in the lowered, inoperative position.

The divider member may include one or more openings, and the retainer arrangement may include a retainer member. The retainer member is movable between a retaining position in which the retainer member extends through and overlies the opening when the divider member is in the lowered, inoperative position to prevent movement of the divider member toward the raised, operative position, and a release position in which the retainer member is capable of passing through the opening to enable the divider member to be moved from the lowered, inoperative position to the raised, operative position.

In another embodiment, the base may be in the form of an elongated member, and the divider member may include a pair of spaced apart ends. A first one of the divider member ends is secured to the base member in a fixed position, and a second one of the divider member ends is releasably secured to the base member for movement between an inoperative position in which the divider member is collapsed toward the base and an operative position in which the second end of the divider member is moved toward the first end of the divider member to place the divider member in the raised, operative position.

The invention also contemplates a method of delineating a boundary on a surface, substantially in accordance with the foregoing summary.

Other aspects, features and advantages of the invention will become apparent to those skilled in the art from the following detailed description and accompanying drawings. It should be understood, however, that the detailed description and specific examples, while indicating certain embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and the construction and operation of typical mechanisms provided with the present invention, will become more readily apparent by referring to be exemplary, and therefore non-limiting, embodiments illustrated in the drawings accompanying and forming a part of this specification, wherein like reference numerals designate the same elements can be several views, and in which.

Figure 1:
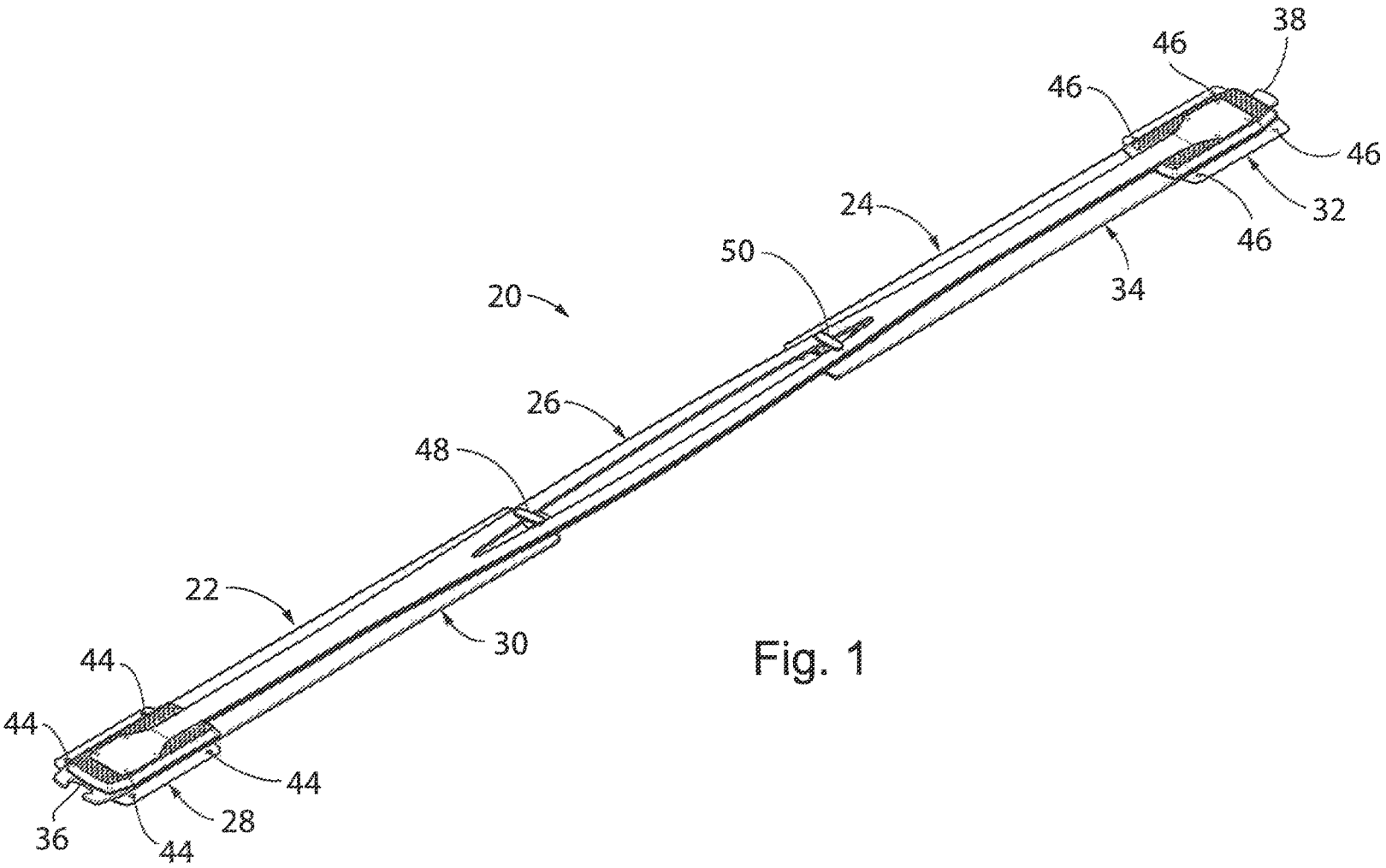
FIG. 1 is an isometric view of a collapsible boundary delineator in accordance with a first embodiment of the present invention.
Figure 2:
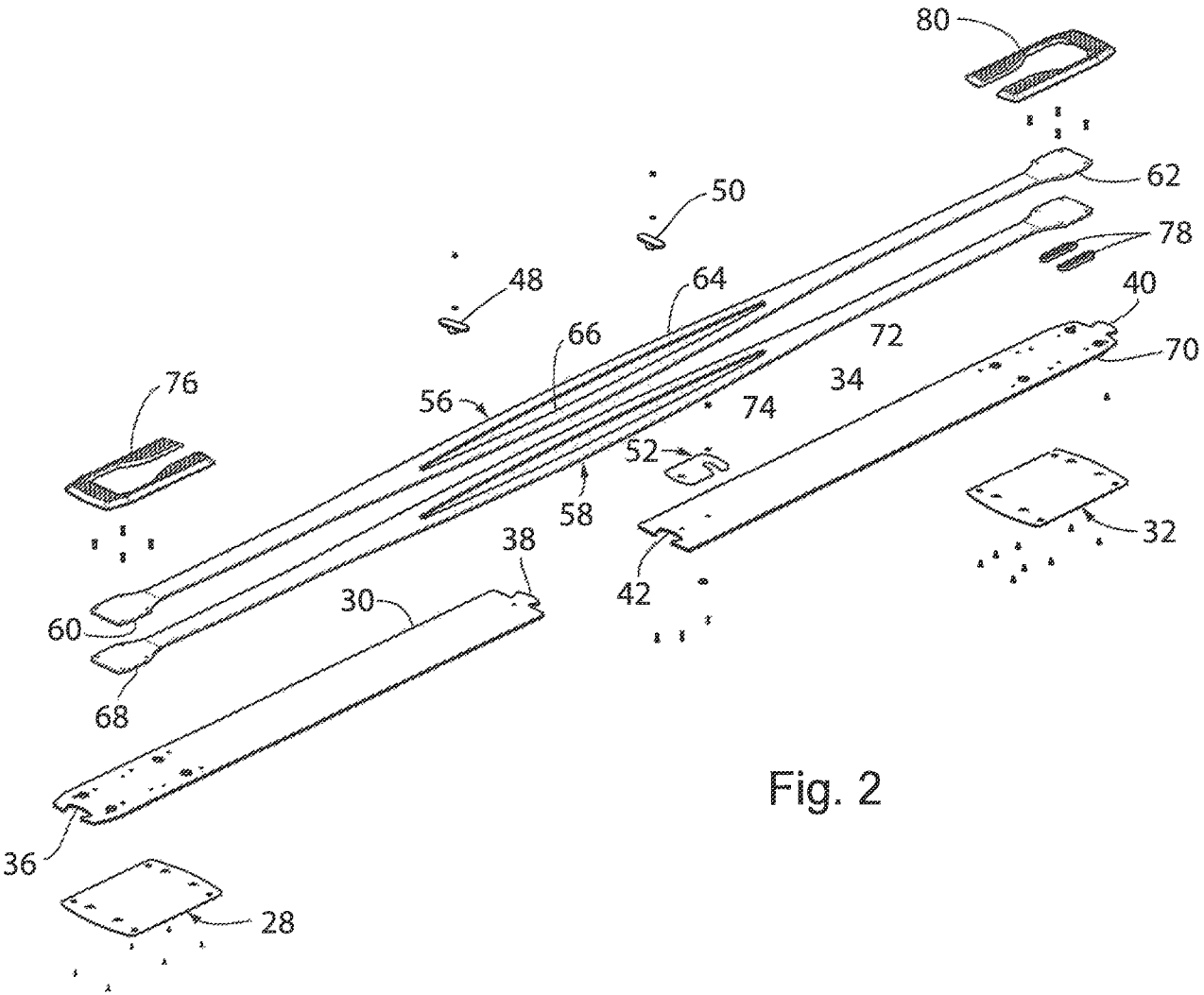
FIG. 2 is an exploded isometric view of the collapsible boundary delineator of FIG. 1.

In describing the embodiments of the invention which are illustrated in the drawings, specific terminology will be resorted to for the sake of clarity. However, it is not intended that the invention be limited to be specific terms so selected and it is to be understood that each specific term includes all technical equivalents which operate in a similar manner to accomplish a similar purpose. For example, the words "connected," "attached," or terms similar thereto are often used. They are not limited to direct connection or attachment, but include connection or attachment to other elements where such connection or attachment is recognized as being equivalent by those skilled in the art.

DETAILED DESCRIPTION

The various features and advantageous details of the subject matter disclosed herein are explained more fully with reference to the non-limiting embodiments described in detail in the following description.

Referring to the following description in which like reference numerals represent like parts throughout the disclosure, a first embodiment of a collapsible boundary delineator in accordance with the present invention is shown in FIGS. 1-8 at 20. The collapsible boundary delineator 20 includes a pair of end sections 22, 24 and a divider portion 26 that extends between and interconnects the end sections 22, 24. The end sections 22, 24 are similarly constructed. End section 22 includes a foot 28 and a base member 30 extending therefrom and underlying divider portion 26. Similarly, end section 24 includes a foot 32 and a base member 34 extending therefrom and underlying divider portion 26. Base member 30 overlies foot 28 and defines an outer end that extends past foot 28, and within which a recess 36 is formed. The inner end of base member 30 is provided with a projection or tab 38. Base member 34 overlies foot 32 and defines an outer end that extends past foot 32 and that is formed with a projection or tab 40 having a shape complementary to that of recess 36. The inner end of base member 34 is provided with a recess 42.

Foot 28 includes a series of openings 44 and foot 32 includes a series of openings 46, which may be employed to receive anchors or the like for securing lane delineator 20 in position on a surface, such as a street, sidewalk, path, trail, etc.

At its inner end, base member 30 includes a movable retainer or latch member 48. Similarly, base member 34 includes a movable retainer or latch member 50 at its inner end. In the illustrated embodiment, latch members 48, 50 are in the form of rotatable T-shaped members, although it is understood that any other satisfactory configuration may be employed. In addition, a latching bracket 52 having a recess 54 is movably mounted to base member 34. In the illustrated embodiment, latching bracket 52 is mounted to the inner end of base member 34 for pivoting movement between an inoperative, disengaged position in which latching bracket 52 overlies base member 34 inwardly of the inner end of base member 34, and an operative, engaged position in which latching bracket 52 is positioned outwardly of the inner end of base member 34. Representatively, latching bracket 52 may be pivotably mounted to base member 34 via a fastener that also functions to rotatably mount latch member 50 to base member 34. It is understood, however, that latching bracket 52 may be movably mounted to base member 34 in any satisfactory manner as desired. A latch or retainer projection 55 is secured to base member 34 inwardly of its inner end, and is configured to be received within recess 54 of latching bracket 53 when latching bracket 52 is in the inoperative, disengaged position.

In the illustrated embodiment, divider portion 26 of lane delineator 20 includes a pair of divider members in the form of an upper divider member 56 and a lower divider member 58. It is understood, however, that any number of divider members, including a single divider member, may be employed. Divider members 56, 58 span between and interconnect end sections 22, 24, and are in the form of relatively long, thin flexible members that are capable of bending and flexing, as will later be described.

Upper divider member 56 has a pair of spaced apart ends 60, 62 and a body section 64 located therebetween. An elongated recess 66 is formed in the central area of body section 64. Somewhat similarly, lower divider member 58 has a pair of spaced apart ends 68, 70 and a body section 72 located therebetween. An elongated recess 74 is formed in the central area of body section 72

In assembly of end section 22, end 60 of upper divider member 56 is positioned over end 68 of lower divider member 58, and the two are secured together to base member 30 toward its outer end using fasteners or any other satisfactory securing arrangement as desired. Foot 28 is secured to the underside of base member 30 toward its outer end, again using fasteners or any other satisfactory securing arrangement as desired. A toe plate 76 may be secured to the upper surface of base member 30 around ends 60, 68 of divider members 56, 58, respectively.

In assembly of end section 24, a pair of guide members 78 are positioned between the underside of end 62 of upper divider member 56 and the upper surface of base member 34, and end 70 of lower divider member 58 is positioned between guide members 78. Guide members 78 and end 62 of upper divider member 56 are secured to base member 34 toward its outer end using fasteners or any other satisfactory securing arrangement as desired. Foot 32 is secured to the underside of base member base member 34 toward its outer end, again using fasteners or any other satisfactory securing arrangement as desired. A toe plate 80 may be secured to the upper surface of base member around ends 62, 70 of divider members 56, 58, respectively, and guide members 78.

Figure 6:
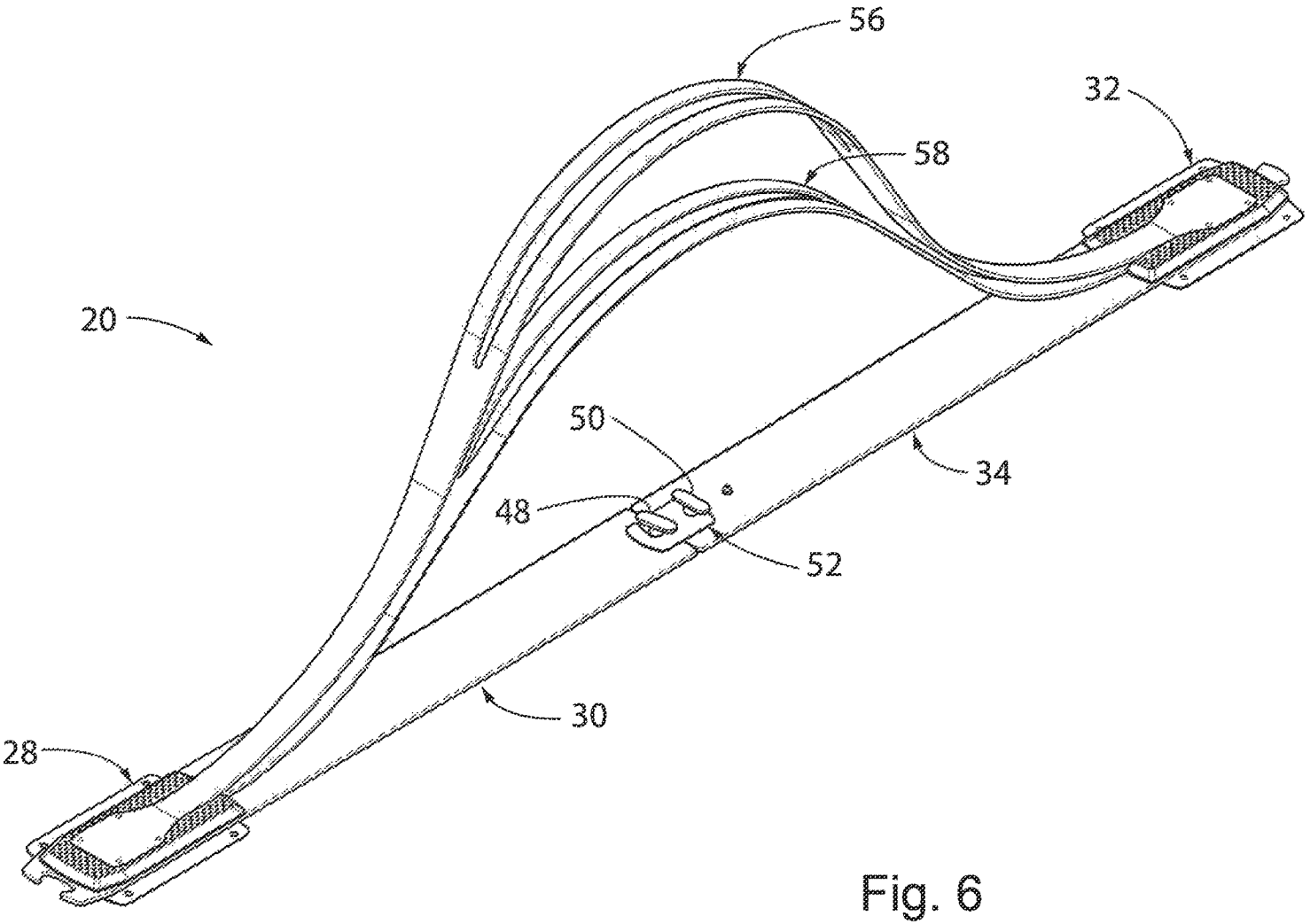
FIG. 6 is a view similar to FIG. 5, showing movement of the divider member to the raised, operative position.

Lane delineator 20 is constructed and arranged so as to be capable of being in a lowered, collapsed or storage configuration as shown in FIG. 1 or a raised, deployed or operative position as shown in FIG. 6.

Figure 3:
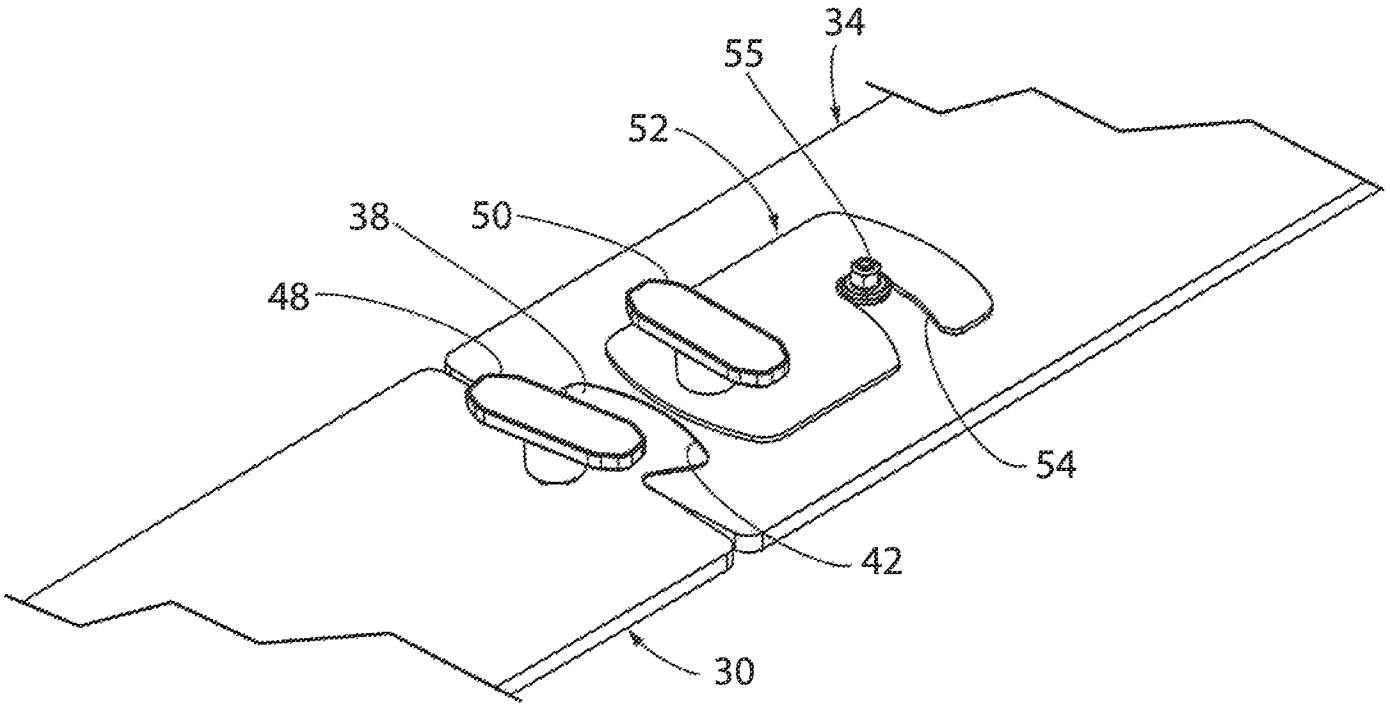
FIG. 3 is an enlarged partial isometric view of end portions of base members forming a part of the collapsible boundary delineator of FIG. 1, showing a latch arrangement in a release position.
Figure 4:
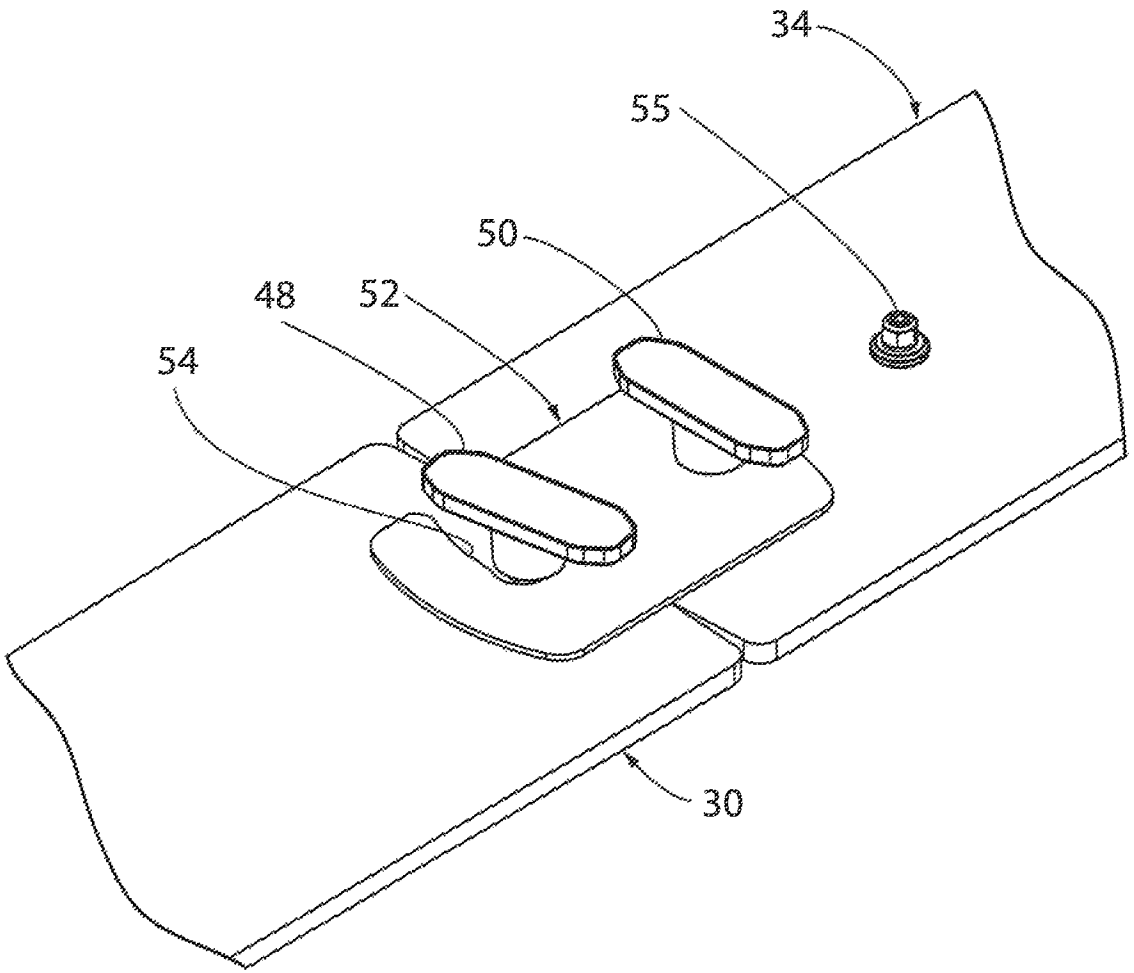
FIG. 4 is a view similar to FIG. 3, showing the latch arrangement in an engaged position.
Figure 5:
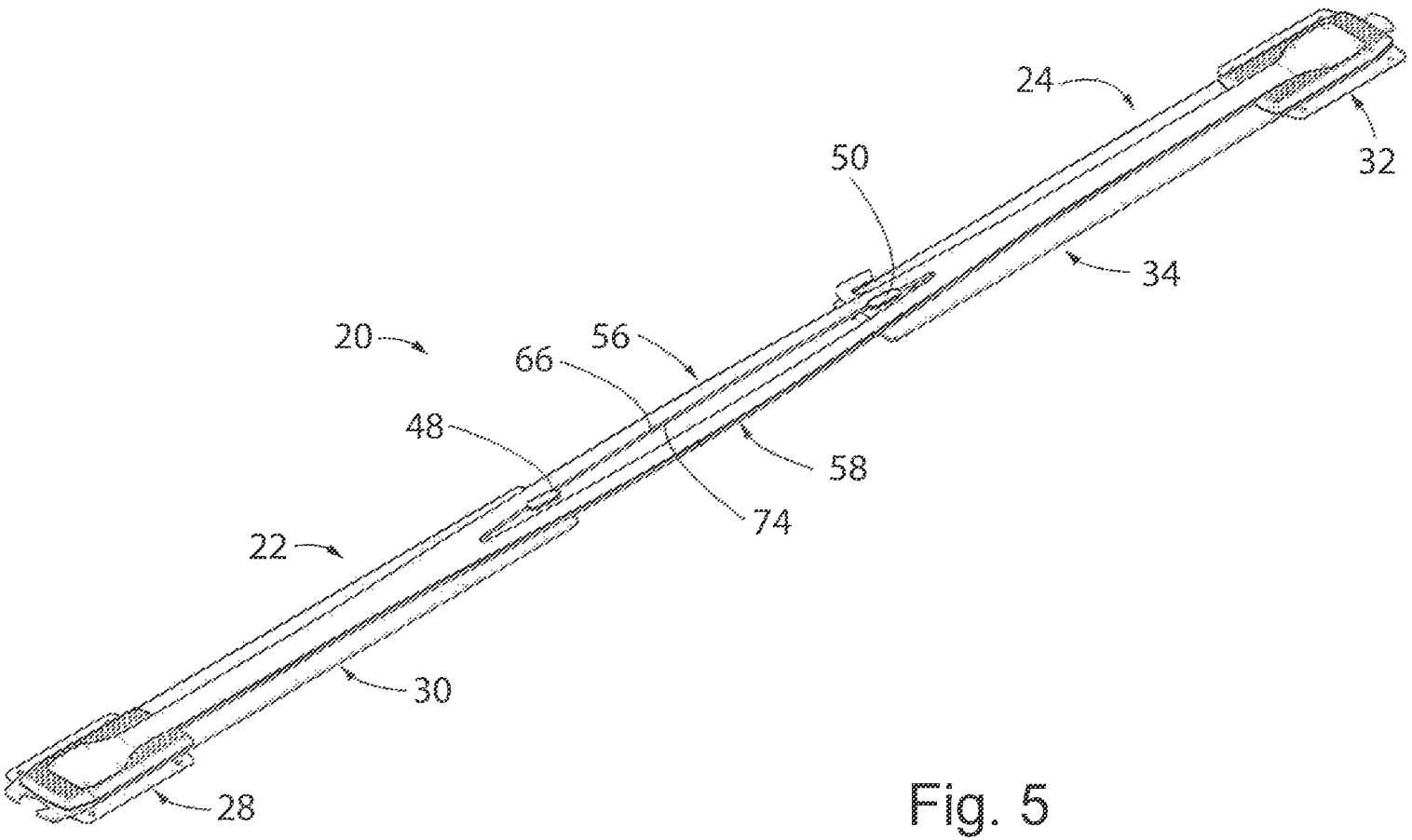
FIG. 5 is a view similar to FIG. 1, showing a retainer arrangement positioned to enable a divider member of the collapsible boundary delineator to be moved from a lowered, inoperative position toward a raised, operative position.

When lane delineator 20 is in the storage configuration as shown in FIG. 1, the heads of latch members 48, 50 are turned so as to overlie upper divider member 56 on either side of recess 66 of upper divider member 56. In this manner, divider portion 24 is maintained in a flat configuration overlying base members 30 and 34 to provide a compact, low profile of lane delineator 20 when in the storage configuration. When it is desired to ready lane delineator 20 for use, a user rotates latch members 48 and 50 so as to position the heads of latch members 48 and 50 parallel to recesses 66, 74 of upper and lower divider members 56, 58, respectively, as shown in FIG. 5. The user then moves the inner ends of base members 30, 34 toward each other while at the same time moving the central areas of upper and lower divider body sections 64, 72, respectively, upwardly away from the upper surfaces of base members 30, 34. During such upward movement of divider members 56, 58, the heads of latch members 48, 50 pass through the recesses 66, 74 of upper and lower divider members 56, 58, respectively. When the inner ends of base members 30, 34 are brought together, projection 38 of base member 30 is positioned within recess 42 of base member 34, as shown in FIGS. 3 and 6, which secures base members 30, 34 together in a manner that prevents axial movement of base members 30, 34 apart from each other. The user then rotates latching bracket 52 away from its inoperative, disengaged position of FIG. 3 to its operative, engaged position of FIG. 4. To accomplish this, the user flexes latching bracket 52 upwardly so that it clears retainer projection 55 and latching bracket 52 can then be pivoted about its pivot connection such that the stem of latch member 48 is positioned within recess 54 of latching bracket 52, as shown in FIG. 4. Such engagement of latching bracket 52 with the stem of latch member 48 positions the central area of latching bracket 52 over the location at which projection 38 of base member 30 is engaged within the recess 42 of base member 34, to prevent disengagement of projection 38 from recess 42 when either base member 30 or base member 34 is subjected to an upward force. Since base members 30, 34 are placed on a ground surface during use, the ground surface underlies the location at which projection 38 is engaged within recess 42, to prevent disengagement of projection 38 from recess 42 when either base member 30 or base member 34 is subjected to a downward force. In this manner, the inner ends of base members 30, 34 are firmly secured together when lane delineator 20 is in the operative, deployed configuration.

As the inner ends of base members 30, 34 are moved together, the central area of upper divider member 56 is deflected or bowed in an upward direction, as shown in FIG. 6, to form a somewhat hump-like configuration above base members 30, 34.

End 70 of lower divider member 58 slides axially in the space between guide members 78 as base members 30, 34 are moved together, and the end surface of lower divider member 58 at end 70 comes into contact with toe plate 80, which prevents further axial movement of lower divider member 50 relative to base member 34. During continued movement of base members 30, 34 together, lower divider member 58 is deflected or bowed in an upward direction, as also shown in FIG. 6, to form a somewhat hump-like configuration above base members 30, 34 but having a lesser height than that of upper divider member 56.

Figure 7:
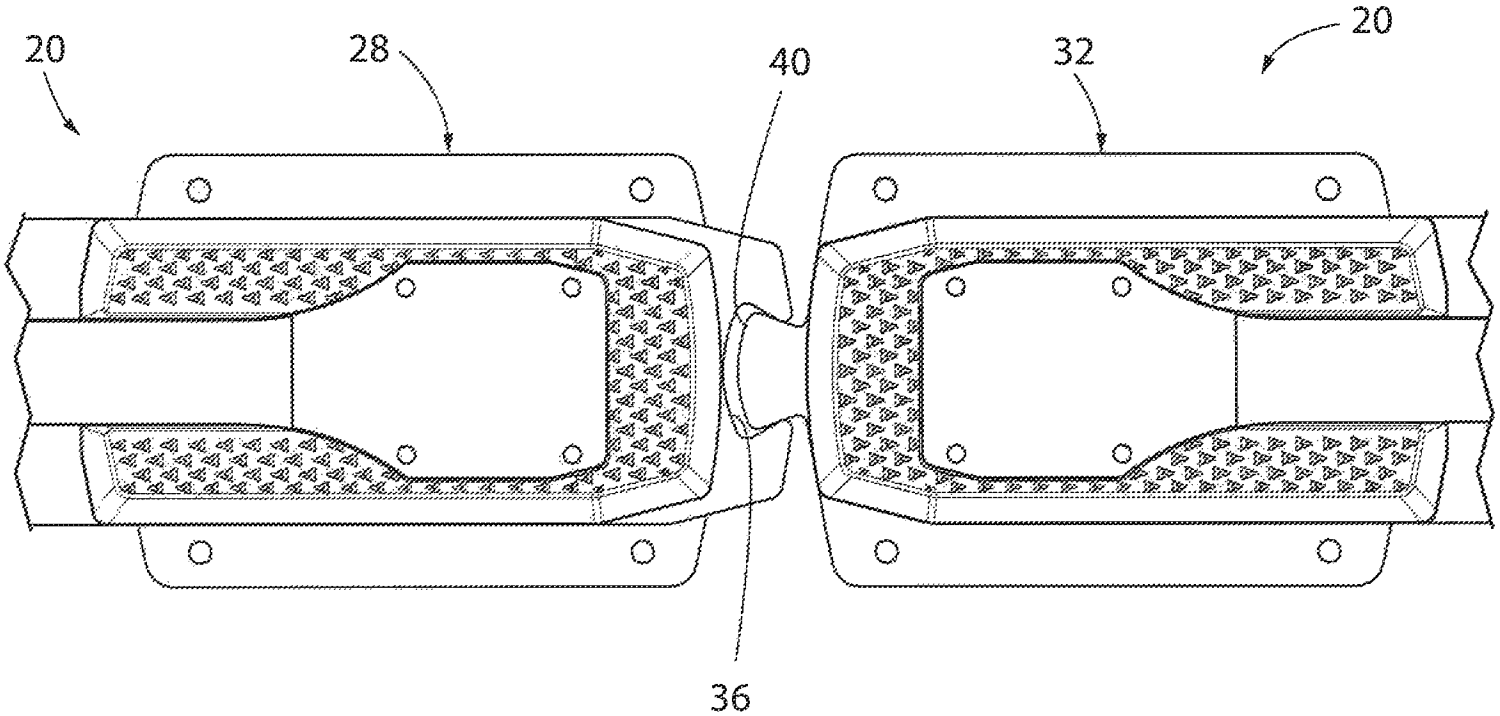
FIG. 7 is a partial bottom plan view showing portions of the base member ends in engagement with each other.
Figure 8:
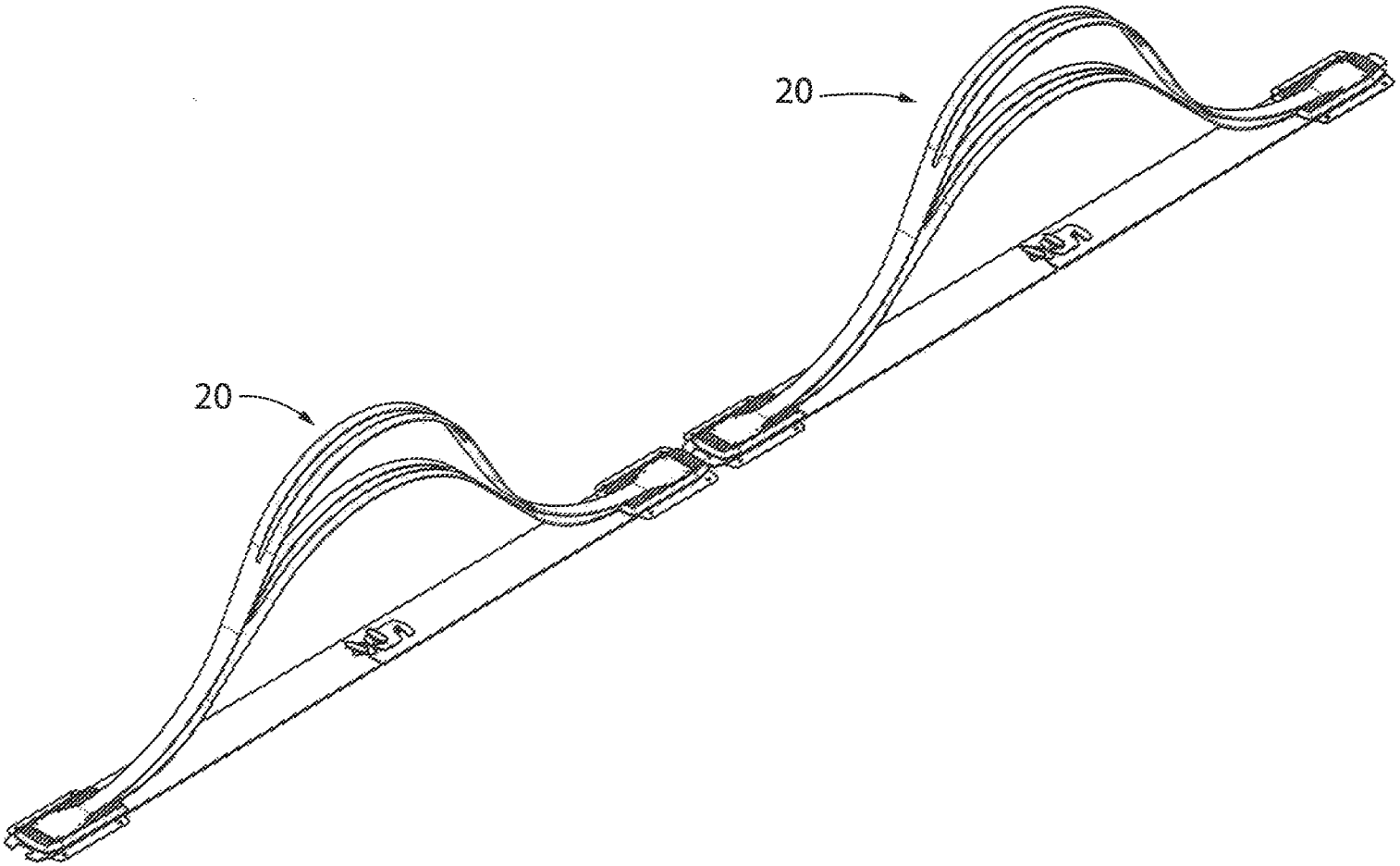
FIG. 8 is an isometric view of a second embodiment of a collapsible boundary delineator in accordance with the present invention, showing a pair of the collapsible boundary delineators secured together.
Figure 9:
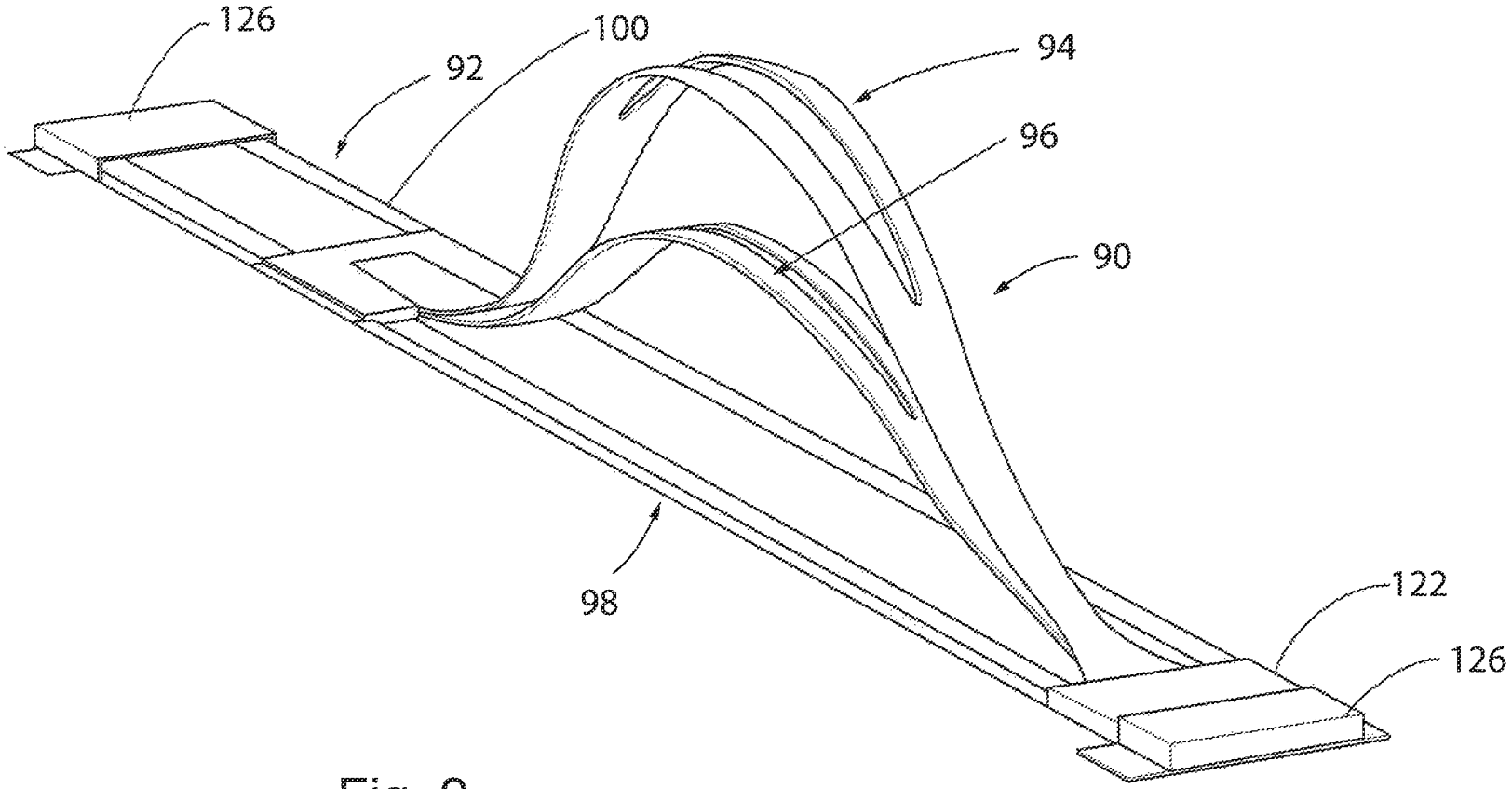
FIG. 9 is an isometric view of one of the collapsible boundary delineators of FIG. 8.
Figure 10:
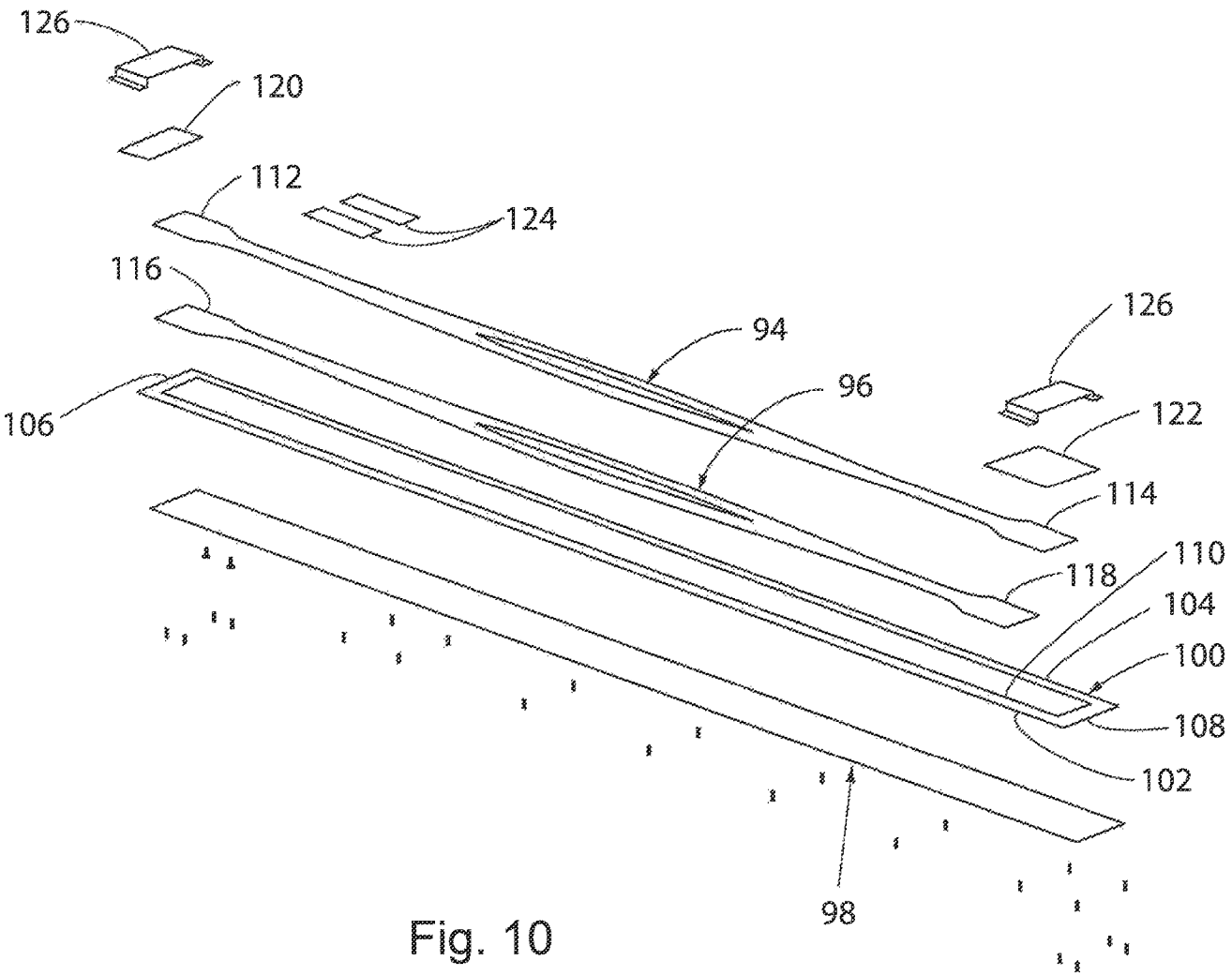
FIG. 10 is an exploded isometric view of the collapsible boundary delineator of FIG. 9.

With base members 30, 34 secured together and divider members 56, 58 elevated as described, the user can position lane delineator 20 on a surface to form a portion of a lane boundary. In a common application, a number of lane delineators 20 can be secured together as shown in FIGS. 7 and 8 to form an elongated stretch of lane boundary. In securing adjacent lane delineators 20 together, the projection or tab 40 of the base member 34 of one lane delineator 20 is placed into the recess 36 of the base member 30 of an adjacent lane delineator 20 to secure adjacent lane delineators 20 together against axial movement. As noted previously, anchors such as fasteners or stakes may be used to secure the feet 28, 32 of the lane delineators 20 to the underlying surface in order to maintain the lane delineators 20 in the desired positions.

When desired, each lane delineator can be returned to its collapsed, inoperative configuration of FIG. 1 by reversing the above steps. The lane delineators 20 can then be stored until needed again, and the low profile of the lane delineators 20 in the collapsed, inoperative configuration minimizes the required storage space.

Representatively, the components of the lane delineator 20 may be formed of a material such as high density polyethylene (HDPE), which provides the required repeatable flexibility of the divider sections 56, 58 and at the same time the required rigidity of the base members 30, 34, when formed with suitable material thicknesses. It is understood, however, that any other suitable material may be employed.

Another embodiment of a collapsible lane delineator in accordance with the present invention is shown at 90 in FIGS. 9-12. In this embodiment, the lane delineator 90 includes a single base member 92, an upper divider member 94 and a lower divider member 96. The base member 92 includes a base plate 98 and a perimeter member 100 that has a pair of spaced-apart side members 102, 104 and a pair of spaced-apart end members 106, 108, which cooperate to define an axially extending open area 110. Perimeter member 110 and base plate 98 are secured together such that perimeter member 100 overlies base plate 98. Open area 110 of perimeter member 100 and the upper surface of base plate 98 cooperate to form an upwardly facing channel of base member 92.

Upper divider member 94 defines a pair of spaced-apart ends 112, 114, and similarly lower divider member 96 defines a pair of spaced-apart ends 116, 118. Lower divider member 96 has a length slightly less than that of upper divider member 94. Upper and lower divider members 94, 96, respectively, and the channel defined by perimeter member open area 110 are configured such that, when in a collapsed, storage position of lane delineator 90, upper divider member 94 overlies lower divider member 96 and both are positioned within open area 110 of perimeter member 100.

A head cover member 120 is secured to perimeter member 100 at the end member 106 of perimeter member 100 so as to overlie one end of the channel defined by perimeter member open area 110. Similarly a foot cover member 122 is secured to perimeter member 100 at the end member 108 of perimeter member 100 so as to overlie the opposite end of the channel defined by perimeter member open area 110. Head cover member 120 overlies ends 112, 116 of upper and lower divider members 94, 96, respectively, when divider members 94, 96 are in the collapsed, inoperative position within the channel defined by perimeter member open area 110. Likewise, foot cover member 122 overlies ends 114, 118 of upper and lower divider members 94, 96, respectively, when divider members 94, 96 are in the collapsed, inoperative position within the channel defined by perimeter member open area 110.

A pair of fold stop members 124 are secured one to each of side members 102, 104 of perimeter member 100. When secured to the side members 102, 104, the fold stop members 124 define an open space therebetween that is sized and configured to allow upper and lower divider members 94, 96, respectively, to pass therethrough to be selectively positioned within and moved outwardly of the channel defined by perimeter member open area 110.

Figure 11:
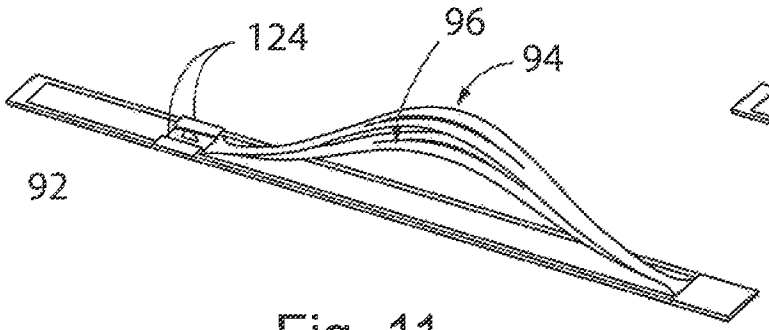
FIG. 11 is an isometric view of the collapsible boundary delineator of FIG. 8 in a lowered, inoperative position.
Figure 12:
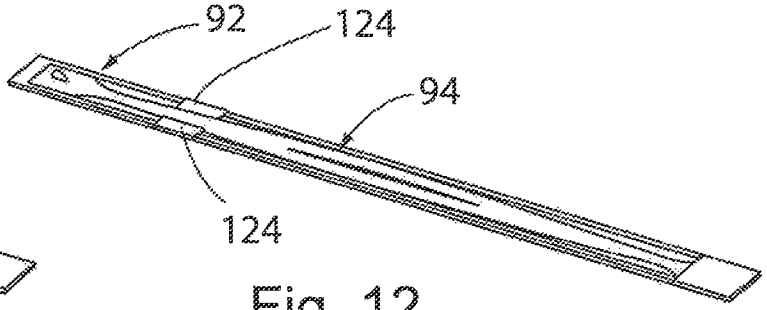
FIG. 12 is an isometric view of the collapsible boundary delineator of FIG. 8 in a raised, operative position.
Figure 13:
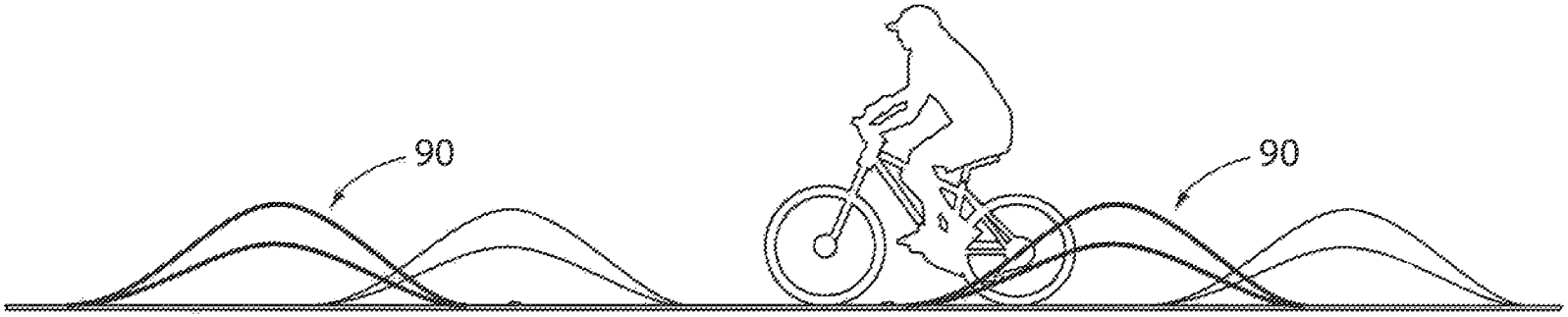
FIGS. 13 and 14 are view illustrating representative applications of the collapsible boundary delineators of FIGS. 1-12.
Figure 14:
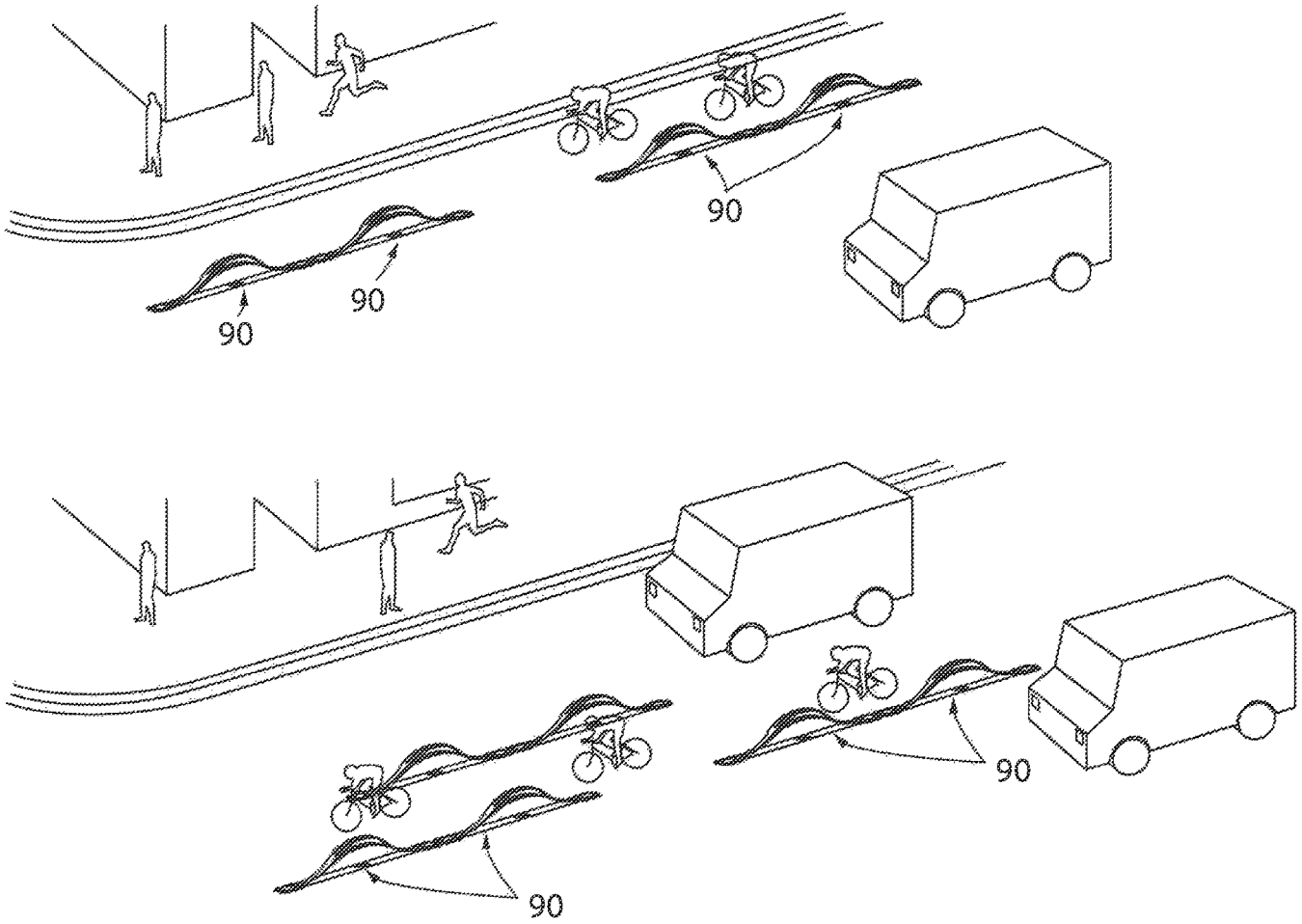

In use, the lane delineator 90 of FIG. 9-12 can be placed in an inoperative, storage configuration in which the lane delineator 90 is in a generally flat condition, and an operative, raised configuration in which the divider members 94, 96 are elevated above base plate 98 and perimeter member 100. Both the inoperative, storage configuration and the operative, raised configuration of lane delineator 90 are illustrated in FIG. 11. As noted previously, the inoperative, storage configuration of lane delineator 20 is provided when divider members 94, 96 are positioned flat and within the channel defined by perimeter member open area 100, in which upper divider member 94 overlies lower divider member 96 and both are fully contained within the channel defined by perimeter member open area 110. To place lane delineator 20 in the operative, raised configuration, the user manually lifts the central area of upper and lower divider members 94, 96, respectively, to withdraw ends 112, 116 of upper and lower divider members 94, 96, respectively, from below head cover member 120 and out of the end of the channel defined by perimeter member 100 adjacent end member 106 of perimeter member 100, and moving the divider members 94, 96 upwardly while maintaining the ends 114, 118, respectively, in position within the channel and below foot cover member 122. As noted above, the divider members 94, 96 and fold stop members 124 are configured such that, during such upward movement of divider members 94, 96, the divider members 94, 96 can be moved outwardly from the recess defined by perimeter member 100 through the space between fold stop members 124. The user then moves the ends 112, 116 of divider members 94, 96, respectively, toward the divider member ends 114, 118, to form a hump-like configuration between the divider member ends 112, 116 and 114, 118. Once the ends 112, 116 of divider members 94, 96, respectively, have been moved past the fold stop members 124, the ends 112, 116 of divider members 94, 96, respectively, are then moved back toward the end of the base from which such folding movement of divider members 94, 96 originated, i.e. back toward the end member 106 of perimeter member 100 so that the ends 112, 116 of divider members 94, 96, respectively, are placed below and into engagement with the fold stop members 124. The divider member ends 94, 96 are configured such that the fold stop members 124 overlie the side portions of the divider member ends 112, 116 to prevent upward movement of divider member ends 112, 116, while fold stop members 124 prevent further axial movement of divider member ends 112, 116 back toward end member 106. Such engagement of divider member ends 112, 116 functions to maintain divider members 94, 96 in the raised, operative position for use. The lane delineator 90 can then be placed in a desired position for use and maintained in position in any satisfactory manner, such as, for example, by means of mounting plates 126 that overlie the ends of the lane the mediator 90 and are secured to the underlying ground or pavement surface.

It is understood that the invention disclosed and defined herein extends to all alternative combinations of two or more of the individual features mentioned or evident from the text and/or drawings. All of these different combinations constitute various alternative aspects of the present invention. The embodiments described herein explained the best modes known for practicing the invention and will enable others skilled in the art to utilize the invention.

Various additions, modifications, and rearrangements are contemplated as being within the scope of the following claims, which particularly point out and distinctly claim the subject matter regarding as the invention, and it is intended that the following claims cover all such additions, modifications, and rearrangements.

We claim:

1. A collapsible boundary delineator, comprising:

a base adapted to be positioned on a ground surface; and a pair of divider members interconnected with the base, wherein the pair of divider members comprises an upper divider member and a lower divider member, wherein the upper and lower divider members are movable relative to the base between a raised, operative position and a lowered, inoperative position, wherein when the upper and lower divider members are in the raised, operative position the lower divider member is spaced below the upper divider member and above the base and the upper and lower divider members are in a non-parallel relationship relative to each other, and wherein when the upper and lower divider members are in the lowered, inoperative position the upper divider member overlies the lower divider member and the lower divider member is sandwiched between the base and the upper divider member, and the upper and lower divider members are in a parallel relationship relative to each other.

2. The collapsible boundary delineator of claim 1, wherein each divider member includes a pair of spaced apart ends, wherein the divider member ends are secured to the base members, and wherein when the base members are engaged together the divider members are in the raised, operative position and when the base members are disengaged from each other the divider members are in the lowered, inoperative position.

3. The collapsible boundary delineator of claim 2, wherein the pair of base members include releasable engagement structure that can be engaged together to maintain the base members in engagement with each other and that can be disengaged to enable the base members to be moved apart from each other.

4. The collapsible boundary delineator of claim 3, wherein the releasable engagement structure comprises an engagement opening located at an end of one of the base members and an engagement tab located at a facing end of the other of the base members, wherein the engagement tab is selectively positioned within the engagement opening to maintain the base members in engagement with each other.

5. The collapsible boundary delineator of claim 3, further comprising a selectively releasable latch arrangement carried by the base members, wherein the latch arrangement is movable between a latching position for selectively maintaining the base members in engagement with each other and a release position for selectively enabling the base members to be moved apart from each other.

6. A collapsible boundary delineator, comprising:

a base adapted to be positioned on a ground surface, wherein the base comprises a pair of base members that are selectively engageable with each other;

a divider member interconnected with the base, wherein the divider member is movable relative to the base between a raised, operative position and a lowered, inoperative position, wherein the divider member includes a pair of spaced apart ends, wherein each of the divider member ends is secured to one of the base members, and wherein when the base members are engaged together the divider member is in the raised, operative position and when the base members are disengaged from each other the divider member is in the lowered, inoperative position; and a retainer arrangement interposed between each base member and the divider member, wherein the retainer arrangement includes a first retainer member carried by a first one of the base members for selectively maintaining the divider member in the lowered, inoperative position relative to the first base member and a second retainer member carried by a second one of the base members for selectively maintaining the divider member in the lowered, inoperative position relative to the second base member, wherein the first and second retainer members are movably mounted to the first and second base members, respectively, for movement between a retaining position in which the divider member is prevented from movement relative to the first and second base members, respectively, away from the lowered, operative position, and a release position in which the first and second retainer members allow the divider member to be moved away from the lowered, inoperative position relative to the first and second base members, respectively, toward the raised, operative position.

7. The collapsible boundary delineator of claim 6, wherein when the divider member is in the lowered, inoperative position the divider member lies in a plane generally parallel to a plane defined by the first and second base members.

8. The collapsible boundary delineator of claim 6, wherein the divider member includes one or more openings, and wherein when the first and second retainer members are in the retaining position, the first and second retainer members extend through and overlie the one or more openings when the divider member is in the lowered, inoperative position to prevent movement of the divider member toward the raised, operative position, and when the first and second retainer members are in the release position, the first and second retainer members are capable of passing through the one or more openings to enable the divider member to be moved from the lowered, inoperative position to the raised, operative position.

9. The collapsible boundary delineator of claim 8, wherein each of the base members includes a retainer member, and wherein the one or more openings in the divider member are configured and arranged so that each of the retainer members overlies the divider member adjacent the one or more openings when the divider member is in the lowered, inoperative position.

10. The collapsible boundary delineator of claim 9, wherein the one or more openings comprises an elongated slot in the divider member.

11. The collapsible boundary delineator of claim 9, wherein each retainer member is in the form of a T-shaped member that is rotatably mounted to its associated base member for movement between the retaining position and the release position.

12. The collapsible boundary delineator of claim 1, wherein the base comprises an elongated member, wherein each divider member includes a pair of spaced apart ends, wherein first ones of the divider member ends are secured to the base member in a fixed position, and wherein second ones of the divider member ends are releasably secured to the base member for movement between an inoperative position in which the divider members are collapsed toward the base and an operative position in which the second ends of the divider members are moved toward the first ends of the divider members to place the divider members in the raised, operative position.

13. A method of delineating a boundary on a surface, comprising the acts of:

providing a plurality of boundary delineators, wherein each boundary delineator includes a base adapted to be positioned on a ground surface and a divider member interconnected with the base, wherein the divider member of each boundary delineator is movable relative to the base of each boundary delineator between a raised, operative position and a lowered, inoperative position, wherein the base of each boundary delineator includes first and second base members, each of which defines an inner end and an outer end, wherein the outer ends of the first and second base members include engagement structure, and wherein the divider member of each boundary delineator defines a first end secured to the first base member at a location inwardly of the engagement structure at the outer end of the first base member and a second end secured to the second base member at a location inwardly of the engagement structure at the outer end of the second base member, and wherein the divider member is movable to the raised, operative position when the inner ends of the first and second base members are moved together and secured to each other, and is movable to the lowered, inoperative position when the inner ends of the first and second base members are moved apart from each other; and placing the divider members of the boundary delineators in the raised, operative position by moving the inner ends of the first and second base members of each boundary delineator together and securing them to each other, and securing the bases of the boundary delineators together in an end-to-end relationship by engaging at least one of the engagement structures of the first and second base members of one of the boundary delineators with at least one of the engagement structures of the first and second base members of an adjacent one of the boundary delineators.

14. The method of claim 13, wherein the inner ends of the first and second base members include releasable engagement structure, and including the steps of selectively securing the releasable engagement structure together to maintain the first and second base members in engagement with each other and selectively separating the releasable engagement structure to enable the first and second base members to be moved apart from each other.

15. The method of claim 14, further comprising a selectively releasable latch arrangement carried by the first and second base members, and selectively moving the latch arrangement between a latching position for selectively maintaining the first and second base members in engagement with each other and a release position for selectively enabling the first and second base members to be moved apart from each other.

16. The method of claim 13, further comprising the act of employing a retainer arrangement interposed between the first and second base members and the divider member for selectively maintaining the divider member in the lowered, inoperative position.

17. The method of claim 16, wherein the divider member includes one or more openings and the retainer arrangement includes a retainer member, and including the act of moving the retainer member to a retaining position in which the retainer member extends through and overlies the opening when the divider member is in the lowered, inoperative position to prevent movement of the divider member toward the raised, operative position, and to a release position in which the retainer member is capable of passing through the opening to enable the divider member to be moved from the lowered, inoperative position to the raised, operative position.

* * * * *